US008921720B2

(12) United States Patent
Chen et al.

(10) Patent No.: US 8,921,720 B2
(45) Date of Patent: Dec. 30, 2014

(54) APPARATUS AND METHOD PERTAINING TO A KEY ASSEMBLY HAVING A PLINTH-RECEIVING KEY MAT

(75) Inventors: Chao Chen, Waterloo (CA); Li Huang, Waterloo (CA)

(73) Assignee: BlackBerry Limited, Waterloo (CA)

( * ) Notice: Subject to any disclaimer, the term of this patent is extended or adjusted under 35 U.S.C. 154(b) by 771 days.

(21) Appl. No.: 13/093,088

(22) Filed: Apr. 25, 2011

(65) Prior Publication Data

US 2012/0267227 A1 Oct. 25, 2012

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 13/702*** | (2006.01) |

(52) U.S. Cl.

CPC ..... *H01H 13/702* (2013.01); *H01H 2205/022* (2013.01); *H01H 2203/02* (2013.01)

USPC ..... 200/5 A

(58) Field of Classification Search

CPC .... H01H 13/704; H01H 13/702; H01H 13/83

See application file for complete search history.

(56) References Cited

U.S. PATENT DOCUMENTS

| | | | | |
|---|---|---|---|---|
| 5,777,281 | A | 7/1998 | Riddiford | |
| 7,423,229 | B2 * | 9/2008 | Chen | 200/314 |
| 7,635,819 | B2 * | 12/2009 | Lee et al. | 200/313 |
| 7,742,040 | B2 | 6/2010 | Jamieson et al. | |
| 2009/0107816 | A1 | 4/2009 | Chen et al. | |
| 2011/0038115 | A1 * | 2/2011 | Halkosaari | 361/679.08 |
| 2012/0000759 | A1 * | 1/2012 | Chen | 200/5 A |

FOREIGN PATENT DOCUMENTS

| | | | |
|---|---|---|---|
| EP | 0859388 | A2 | 8/1998 |
| EP | 1316979 | A1 | 6/2003 |
| EP | 1959468 | A1 | 8/2008 |
| GB | 2346487 | A1 | 8/2000 |

OTHER PUBLICATIONS

Extended European Search Report from related EP Application No. 11163790.6; Oct. 11, 2011; 6 pages.

* cited by examiner

*Primary Examiner* — Renee Luebke
*Assistant Examiner* — Lheiren Mae A Caroc
(74) *Attorney, Agent, or Firm* — Fitch, Even, Tabin & Flannery LLP

(57) ABSTRACT

A key assembly comprises a contact-responsive switch and a keycap having a plinth extending from an underside surface thereof. A key mat disposed between the keycap and the contact-responsive switch has a recessed area formed therein. This recessed area is sized and configured to receive the keycap's plinth. If desired, an adhesive can physically adhere the keycap to the key mat. By one approach, the key assembly also comprises a substantially-planar elastic layer disposed between the keycap and the contact-responsive switch. If desired, this elastic layer and the aforementioned key mat are integrally coupled to one another. By one approach this elastic layer has at least one opening disposed therethrough. This opening (or these openings) can be disposed at least in part in common with the aforementioned recessed area of the key mat.

11 Claims, 3 Drawing Sheets

APPARATUS AND METHOD PERTAINING TO A KEY ASSEMBLY HAVING A PLINTH-RECEIVING KEY MAT

TECHNICAL FIELD

This disclosure relates generally to key assemblies.

BACKGROUND

Key assemblies are known in the art. Key assemblies often comprise a keycap that works in combination with a contact-responsive switch. The keycap typically provides a surface configured to interact with an end-user's finger. By ordinarily biasing the keycap away from the contact-responsive switch, the end user can selectively press the keycap towards the contact-responsive switch to momentary close (or open, if desired) the latter. Upon releasing this pressure the keycap then returns to its stand-by position.

Some key assemblies are so-called film-style key assemblies. Such an assembly can comprise a silicone key mat having a raised area (presenting, for example, a relatively short isosceles-trapezoidal cross section) and a corresponding conformal upper layer comprised of a resilient material such as thermoplastic polyurethane (TPU). The key mat typically serves to make physical contact with the contact-responsive switch (or to at least transfer the end-user's finger pressure to that switch) while the resilient material typically serves to bias a corresponding keycap (which often has a flat, planar bottom surface that rests atop the aforementioned raised area) away from the contact-responsive switch.

While satisfactory for many application settings, such a film-style key assembly nevertheless poses certain concerns. For example, the keycap in such an assembly can sometimes be inadvertently peeled away from the raised area when subjected to a pulling force. As another example, such a key assembly can exhibit relatively poor tactile feel owing, at least in part, to having the resilient material conformally track the sides of the raised area of the silicone key mat. In particular, this configuration permits the resilient material to considerably increase the actuation force needed to urge the keycap towards the contact-responsive switch and hence increases the overall rigidity of the key assembly. This resilient material can also laterally transfer actuation forces in a manner that can permit unwanted interaction between, for example, adjacent key assemblies as comprise a part of a keyboard.

Elements in the figures are illustrated for simplicity and clarity and have not necessarily been drawn to scale. For example, the dimensions or relative positioning of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure. Certain actions or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, a key assembly comprises a keycap having a plinth extending from an underside surface thereof and a contact-responsive switch. A key mat disposed between the keycap and the contact-responsive switch has a recessed area formed therein. This recessed area is sized and configured to receive the plinth.

By one approach this recessed area is sized and configured to conformally receive the plinth. If desired, an adhesive can serve to physically adhere the keycap to the key mat.

By one approach, the key assembly also comprises an elastic layer disposed between the keycap and the contact-responsive switch. If desired, this elastic layer and the aforementioned key mat are integrally coupled to one another. By one approach this elastic layer has at least one opening disposed therethrough. This opening (or these openings) can be disposed at least in part in common with the aforementioned recessed area of the key mat.

So configured, the elastic material serves to aid in biasing the keycap away from the contact-responsive switch while avoiding undue perpendicular rigidity that can contribute to a poor tactile feel. Such an approach also serves to reduce the likelihood that the keycap can be inadvertently peeled away from the key assembly. The result is a key assembly that is both more durable and that has a better feel during use.

These teachings are readily implemented using common and ordinary materials and fabrication methodologies. Accordingly such benefits can be achieved in an economical manner. These teachings are also highly scalable and can serve with a wide variety of keycap sizes, shapes, and form factors.

Figure 1:
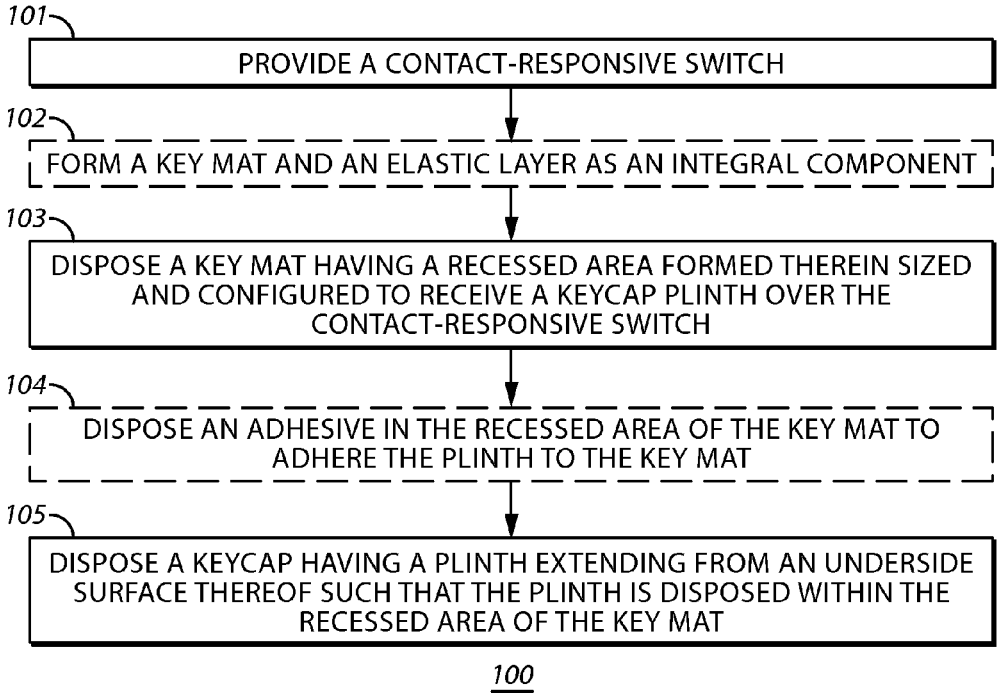
FIG. 1 comprises a flow diagram as configured in accordance with various embodiments of the disclosure.

These and other benefits may become clearer upon making a thorough review and study of the following detailed description. Referring now to the drawings, and in particular to FIG. 1, an illustrative process 100 that is compatible with many of these teachings will now be presented. This process 100 describes, in general, an approach to forming a key assembly. It will be understood that these steps can be carried out a plurality of times in order to form a plurality of key assemblies that together comprise, for example, a keyboard.

At step 101 this process 100 provides a contact-responsive switch. Such switches are well known in the art and often (though not always) comprise normally-open switches. Accordingly, and further as these teachings are not necessarily overly sensitive to particular choices in these regards, further elaboration regarding the construction of such switches will not be provided here aside from noting that contact-responsive switches designed for use in a mobile communication device application setting often have a dome size of about 3 to 6 millimeters.

This process 100 accommodates, as will be described below, the use of a key mat. As an optional step 102, this process 100 will also accommodate forming this key mat and an elastic layer as an integral component. By way of illustration and not by way of limitation, and referring momentarily to FIG. 2, this elastic layer 200 can be comprised of a resilient material of choice. For many application settings this resilient material can comprise thermoplastic polyurethane.

Figure 2:
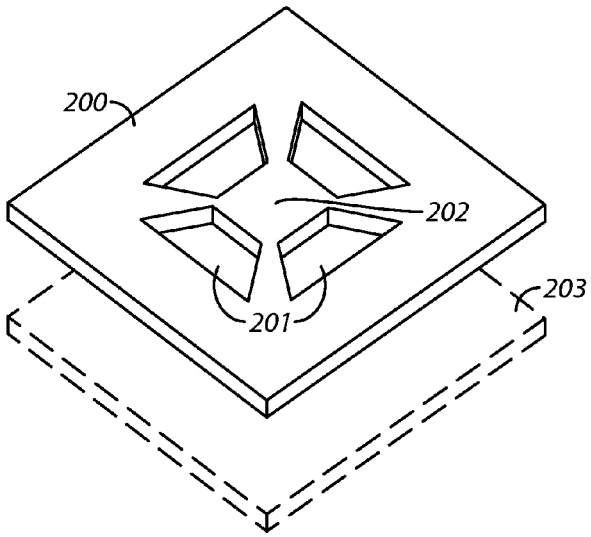
FIG. 2 comprises a perspective view as configured in accordance with various embodiments of the disclosure.

As illustrated, this elastic layer 200 can have at least one opening 201 disposed therethrough. By one approach this can comprise providing a plurality of such openings 201. As will become more evident below, this opening 201 can be disposed at least in part in common with a recessed area of the aforementioned key mat. By one approach, and as shown in FIG. 2, a plurality of such openings 201 can be disposed axially symmetrical with respect to a central point of reference 202. As shown below, this central point of reference 202 can, in turn, also be disposed within the aforementioned recessed area of the key mat (i.e., in common registration with that recessed area).

Figure 3:
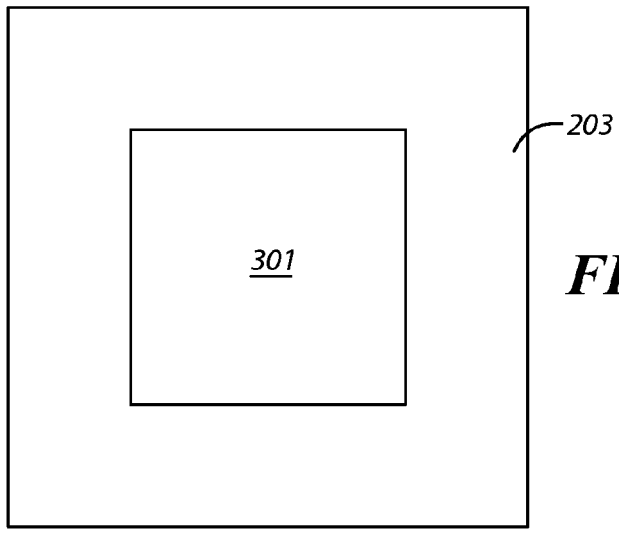
FIG. 3 comprises a top-plan view as configured in accordance with various embodiments of the disclosure.

Optionally, if desired, this elastic layer 200 can be formed in conjunction with an ink pattern 203. As shown in FIG. 3, this ink pattern 203 can have a centrally-disposed open area 301 that surrounds the aforementioned openings 201. Though shown in FIG. 2 for the sake of clarity as being separated from the elastic layer 200, it will be understood that this ink pattern 203 will typically be applied to the elastic layer 200. This may comprise, by one approach, printing this ink pattern 203 on the underside surface of the elastic layer 200. This ink pattern 203 can serve, for example, to occlude light when the completed key assembly comprises an illuminated key assembly. The use of such ink patterns in a key assembly comprises a known area of endeavor. Accordingly, no further elaboration in these regards is provided here.

As noted above, this elastic layer 200 (formed, for example, of thermoplastic polyurethane) can be integrally formed with a corresponding key mat 400 (formed, for example, of silicone) to yield an integral component. (As used herein, this reference to "integral" will be understood to refer to a combination and joinder that is sufficiently complete so as to consider the combined elements to be as one. Accordingly, two items would not be considered "integral" with respect to one another if they are merely connected to one another by the action of a holding member such as a screw, bolt, clamp, clip, or the like.) One can employ, for example, a co-molding process as known in the art to achieve this result.

Figure 4:
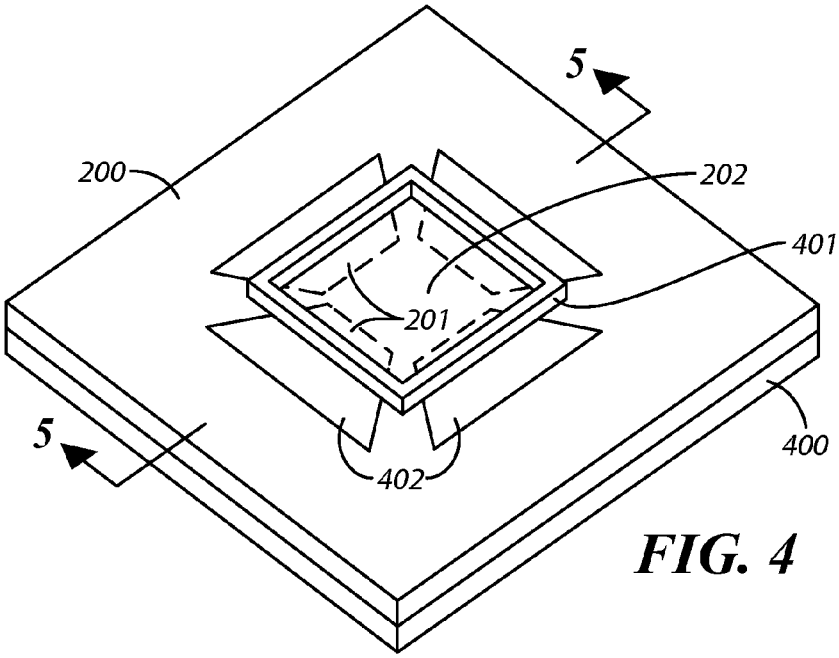
FIG. 4 comprises a perspective view as configured in accordance with various embodiments of the disclosure.

Referring now momentarily to FIG. 4, this can comprise forming the elastic layer 200 on a first side of the key mat 400. Raised portions 402 of the key mat 400 can extend into the aforementioned openings 201 in the elastic layer 200. By one approach these raised portions 402 can be coextensive with the boundaries of those openings 201 to thereby fully fill those openings 201.

This key mat 400 further includes a raised wall 401 that extends outwardly of the key mat 400 and that forms within its boundaries the aforementioned recessed area. As will be shown below, this recessed area is sized and configured to receive the plinth of a keycap to facilitate physically coupling the keycap to the key mat 400. FIG. 4 also serves to illustrate one illustrative way (of many) by which the aforementioned central point of reference 202 of the elastic layer 200 is disposed within this recessed area of the key mat 400. In this particular example, this central point of reference 202 (and other portions of the elastic layer 200 that lead to this central point of reference 202) are shown in phantom lines because these structural elements are covered by the material comprising the key mat 400. Other possibilities in these regards are possible, of course. FIG. 4 also serves to illustrate a point noted earlier that at least a portion of the elastic layer openings 201 can also be located within the registration ambit of this recessed area.

So configured, the aforementioned elastic layer 200 comprises a substantially-planar member. In particular, this elastic layer 200 does not arc outwardly in order to conform to an outwardly-disposed bulge in the key mat 400 as typifies many prior art embodiments. Accordingly, although this elastic layer 200 can still serve to bias a keycap away from the opposing side of the key mat 400, such a planar configuration serves to improve the tactile feel of a resultant key assembly.

By one approach, the key mat 400, the elastic layer 200, or both may be comprised of transparent or highly translucent material. Such an approach can serve to support the provision of an internally-illuminated key assembly. Internally-illuminated keyboards and the like comprise a known area of endeavor that requires no further description here.

In any event, and regardless of whether the key mat has been integrally combined with an elastic layer, with reference to FIG. 1, at step 103 this process 100 provides for disposing a key mat (having a recessed area formed therein that is sized and configured to receive a keycap plinth) over the previously provided contact-responsive switch.

Figure 5:
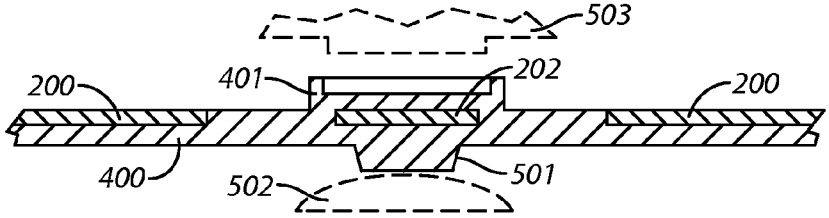
FIG. 5 comprises a side-elevational sectioned view as configured in accordance with various embodiments of the disclosure.

FIG. 5 presents one illustrative example in these regards. Here, the previously described key mat 400 (which in this example is integrally combined with an elastic layer 200 as explained above) is shown to also have a key feature 501 that is closely disposed with respect to a contact-responsive switch 502 of choice. The degree of proximity between these two elements can vary with respect to the details of a given application setting. Generally speaking, these elements should be close enough that the key feature 501 can actuate the contact-responsive switch 502 when an end user properly interacts with the key assembly in an ordinary and expected manner.

Figure 6:
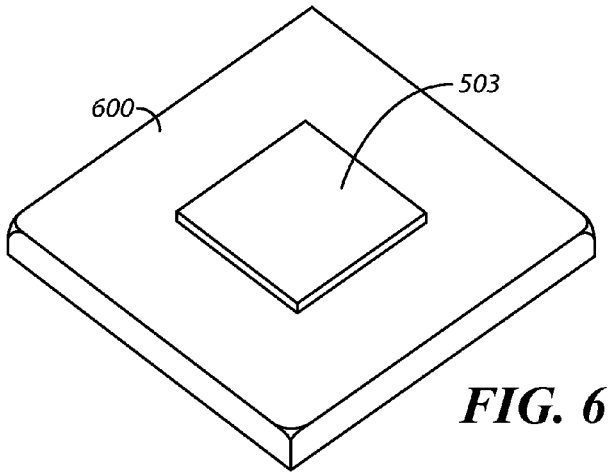
FIG. 6 comprises a perspective view as configured in accordance with various embodiments of the disclosure.

As explained above, the key mat's recessed area is sized and configured to receive a keycap's plinth. FIG. 5 illustrates such a plinth 503. In this particular illustration the plinth 503 is not yet disposed within the key mat's recessed area. FIG. 6 offers a view of the underside of a keycap 600 having such a plinth 503. For many application settings this plinth 503 can comprise a unitary part of the keycap 600 as when these two elements comprise features of a single molded part. These teachings will accommodate other approaches in these regards, however. For example, part or all of the plinth 503 can be permanently or removably attached to the keycap 600 using any attachment methodology of choice. It would also be possible for the plinth 503 to itself be comprised of a plurality of separate elements that may, or may not, be in physical contact with one another as desired.

Figure 7:
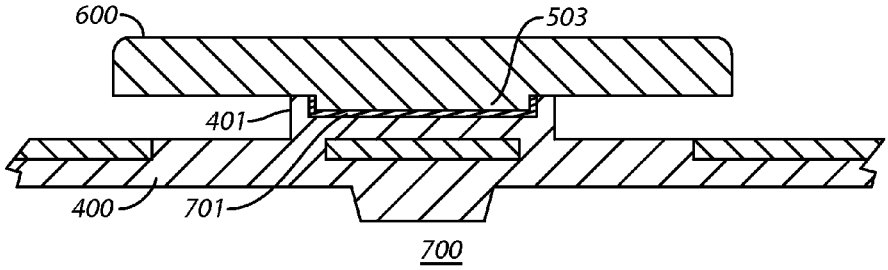
FIG. 7 comprises a side-elevational sectioned detail view as configured in accordance with various embodiments of the disclosure.

By one approach the key mat's recessed area can be sized and configured to tightly conform to the keycap's plinth 503. In this case, it is possible that the resultant compressive force may suffice to retain the keycap in an installed orientation. Referring again to FIG. 1, at optional step 104 this process 100 will also accommodate disposing an adhesive in this recessed area to adhere the plinth 503 to the key mat 400. FIG. 7 depicts the use of such an adhesive 701 in this manner. The particular adhesive 701 employed, of course, can vary with respect to the application setting, the choice of materials used for the plinth 503 and the key mat 400, and so forth. For many application settings a so-called instant glue or a glue that cures with exposure to ultraviolet light may be used with satisfactory results.

In any event, with continued reference to both FIGS. 1 and 7, at step 105 this process 100 then provides for disposing a keycap 600 having a plinth 503 extending from an underside surface thereof such that the plinth 503 is disposed within the key mat's recessed area to thereby form a corresponding key assembly 700. So configured (and with reference to both FIGS. 5 and 7), the key assembly 700 will rest in a quiescent state that leaves the contact-responsive switch 502 disengaged.

When an end user presses on the keycap 600, however, the key mat 400 will be urged towards the contact-responsive switch 502 until the key feature 501 makes operable contact therewith to close (or open, as the case may be) the contact-responsive switch 502. This state persists until the end user releases this pressure. The key mat 400, assisted in considerable part by the elastic layer 200, then returns to its quiescent state of rest and the key feature 501 disengages with the contact-responsive switch 502.

The aforementioned openings 201 in the elastic layer 200 are not so large as to unduly interfere with the elastic layer's 200 significant contribution in the above-described regards. These openings 201 are of sufficient size, however, to both improve the perceptible tactile feel of the key assembly 700 and also to considerably reduce any physical lateral crosstalk between this particular key assembly 700 and any adjacent key assemblies.

Figure 8:
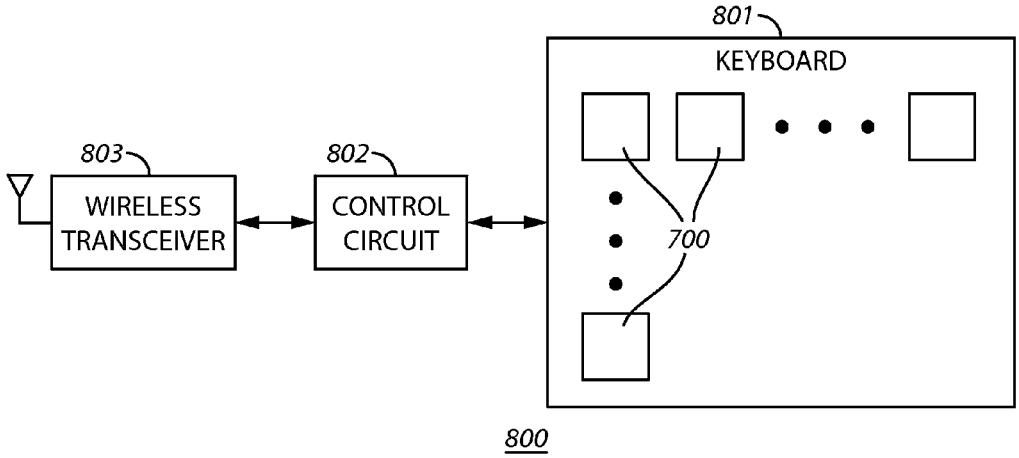
FIG. 8 comprises a block diagram as configured in accordance with various embodiments of the disclosure.

Such a key assembly 700 can comprise a part of a larger assembly. As one illustrative example in these regards, and referring now to FIG. 8, an assembly 800 such as a wireless communications apparatus (such as a cellular telephony device, a push-to-talk device, and so forth) can include a keyboard 801 that itself comprises, at least in part, a plurality of such key assemblies 700. Such a keyboard 801 might comprise, for example, a standard alphabetic-character keyboard (having, for example, a traditional offset QWERTY-style arrangement of keys).

Such a keyboard 801 can, in turn, operably couple to a control circuit 802 that itself operably couples to a wireless transceiver 803 of choice. Such a control circuit 802 can comprise a fixed-purpose hard-wired platform or can comprise a partially or wholly programmable platform. Such architectural options are well known and understood in the art and require no further description here. So configured, the keyboard 801 can permit an end user to provide instructions or content to the control circuit 802 as appropriate to control circuit's functionality and capabilities.

Such a key assembly can be readily manufactured using readily-available materials and fabrication techniques. Accordingly, these teachings can be employed to leverage and further extend the use and value of such existing approaches. These teachings are also readily scaled to accommodate a variety of differently-sized contact-responsive switches and key caps and a variety of differently-arranged keyboards. These teachings can be economically practiced and serve to provide a key assembly that is reliable and durable during use.

Those skilled in the art will recognize that a wide variety of modifications, alterations, and combinations can be made with respect to the above described embodiments without departing from the spirit and scope of the disclosure, and that such modifications, alterations, and combinations are to be viewed as being within the ambit of the inventive concept.

We claim:

1. An apparatus comprising:
a key assembly comprising:
a keycap having a plinth extending from an underside surface thereof;
a contact-responsive switch;
a key mat comprised of a first material and disposed between the keycap and the contact-responsive switch and having:
a recessed area formed therein sized and configured to receive the plinth; and
a key feature comprised at least in part of the first material and configured to actuate the contact-responsive switch; and
an elastic layer comprised of a second material that is different from the first material and that is disposed at least in part within the key mat between the recessed area and the key feature such that at least some of the first material and some of the second material is disposed between the recessed area and the key feature.

2. The apparatus of claim 1 wherein the key mat is comprised of silicone.

3. The apparatus of claim 1 further comprising:
an adhesive disposed within the recessed area to adhere the plinth to the key mat.

4. The apparatus of claim 1 wherein the recessed area is sized and configured to conformally receive the plinth.

5. The apparatus of claim 1 wherein the elastic layer is comprised of thermoplastic polyurethane.

6. The apparatus of claim 1 wherein first material and the second material are integrally coupled to one another.

7. The apparatus of claim 1 further comprising:
a keyboard comprised of a plurality of the key assemblies.

8. A wireless communications apparatus comprising:
a wireless transceiver;
a control circuit operably coupled to the wireless transceiver;
a keyboard operably coupled to the control circuit, the keyboard comprising a plurality of key assemblies wherein at least some of the key assemblies each comprise:
a keycap having a plinth extending from an underside surface thereof;
a contact-responsive switch;
a key mat comprised of a first material and disposed between the keycap and the contact-responsive switch and having:
a recessed area formed therein sized and configured to receive the plinth; and
a key feature comprised at least in part of the first material and configured to actuate the contact-responsive switch; and
an elastic layer comprised of a second material that is different from the first material and that is disposed at least in part within the key mat between the recessed area and the key feature such that at least some of the first material and some of the second material is disposed between the recessed area and the key feature.

9. A method comprising:
providing a contact-responsive switch;
disposing a key mat over the contact-responsive switch, the key mat comprised of a first material and having:
a recessed area formed therein sized and configured to receive a keycap plinth;

a key feature comprised at least in part of the first material and configured to actuate the contact-responsive switch; and an elastic layer comprised of a second material that is different from the first material and that is disposed at least in part within the key mat between the recessed area and the key feature such that at least some of the first material and some of the second material is disposed between the recessed area and the key feature;

disposing a keycap having a plinth extending from an underside surface thereof such that the plinth is disposed within the recessed area of the key mat.

10. The method of claim 9 further comprising:

disposing an adhesive in the recessed area of the key mat to adhere the plinth to the key mat.

11. The method of claim 9 further comprising:

forming the first material and the second material as an integral component.

* * * * *